United States Patent [19]

Kydd

[11] Patent Number: 4,457,830

[45] Date of Patent: Jul. 3, 1984

[54] PETROLEUM HYDROCONVERSION USING ACID PRECIPITATION OF PREASPHALTENES IN RESID RECYCLE

[75] Inventor: Paul H. Kydd, Lawrenceville, N.J.

[73] Assignee: HRI, Inc., Gibbsboro, N.J.

[21] Appl. No.: 334,857

[22] Filed: Dec. 28, 1981

[51] Int. Cl.[3] ..... C10G 47/08; C10G 69/06

[52] U.S. Cl. ..... 208/50; 208/95; 208/98; 208/108; 208/256; 208/281

[58] Field of Search ..... 208/95, 98, 108, 48 R, 208/50, 256, 281, 52 R, 53

[56] References Cited

U.S. PATENT DOCUMENTS

| | | | |
|---|---|---|---|
| 2,209,123 | 7/1940 | Koelbel | 208/17 X |
| 2,352,236 | 6/1944 | Thomas | 208/90 |
| 2,796,387 | 6/1957 | Schmidt | 208/87 |
| 2,800,427 | 7/1957 | Junk et al. | 208/87 |
| 2,966,450 | 12/1960 | Kimberlin et al. | 208/10 |
| 3,085,061 | 4/1963 | Metrailer | 208/91 |
| 3,412,010 | 11/1968 | Alpert et al. | 208/112 |
| 3,622,499 | 11/1971 | Stine et al. | 208/108 |
| 4,082,648 | 4/1978 | Murphy | 208/97 |
| 4,390,416 | 6/1983 | Ritter et al. | 208/120 |

FOREIGN PATENT DOCUMENTS

| | | | |
|---|---|---|---|
| 299925 | 11/1928 | United Kingdom | 208/98 |

*Primary Examiner*—Delbert E. Gantz
*Assistant Examiner*—G. E. Schmitkons
*Attorney, Agent, or Firm*—Vincent A. Mallare; Fred A. Wilson

[57] ABSTRACT

A process for catalytic hydroconversion of heavy petroleum feedstocks containing preasphaltenes to produce lower-boiling hydrocarbon liquid products. In the process, an inorganic acid is added to the reactor effluent residual fraction boiling above about 950° F. to produce substantial precipitation of the preasphaltene materials. The clarified overhead fraction is recycled to the reaction zone, and the precipitated preasphaltene material is passed to further processing, such as coking to recover additional light oils. The reactor can advantageously be an upflow ebullated catalytic bed type and may use fine size catalyst for increased hydroconversion.

9 Claims, 1 Drawing Figure

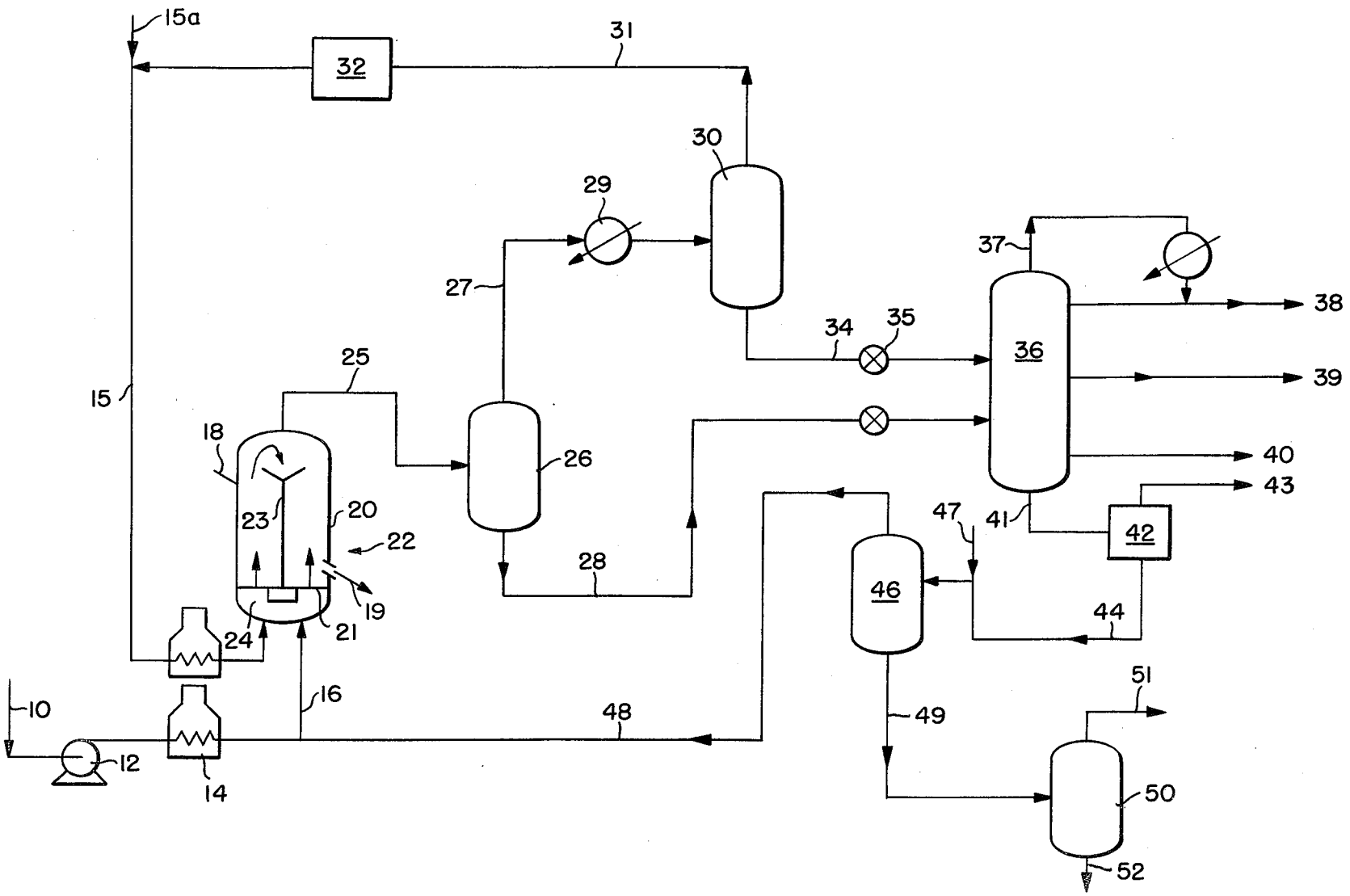
10
12
14
15
15a
16
18
19
20
21
22
23
24
25
26
27
28
29
30
31
32
34
35
36
37
38
39
40
41
42
43
44
46
47
48
49
50
51
52

PETROLEUM HYDROCONVERSION USING ACID PRECIPITATION OF PREASPHALTENES IN RESID RECYCLE

BACKGROUND OF THE INVENTION

This invention pertains to catalytic hydroconversion of petroleum feedstocks containing preasphaltenes to produce lower-boiling hydrocarbon liquid products. It pertains particularly to a catalytic hydroconversion process in which the residual fraction boiling above about 975° F. is treated with an acid to precipitate out preasphaltenes, metals and nitrogen compounds, prior to recycling the supernatant stream to the reaction zone.

It is known that recycle of residual oil fractions can increase the percentage conversion achieved in catalytic hydrogenation operations, such as for H-Oil TM process operations on heavy petroleum feedstocks. Unfortunately, the residual material cannot be recycled to extinction in the reactor because it is necessary to eliminate from the system inorganic contaminants such as metals, sediment, and spent catalyst fines, and refractory organic materials such as polycyclic aromatics and carbon. It is desirable to provide a means for eliminating as much of this inorganic material as possible, and recycling as much as possible of the organic material to the reaction zone for further conversion to distillate products.

One process for removing preasphaltenes from heavy petroleum feedstocks is based on using a solvent precipitation step, wherein a light naphtha product fraction which is a poor solvent is added to the reacted separator bottoms material to precipitate preasphaltenes and solids. The separator overhead material which would then be substantially free of preasphaltenes and solids is passed to the fractionation step, and the bottoms material recycled to the catalytic reactor, so that the non-distillable material could be further cracked without building up high levels of solids and high viscosity organics in the reactor. U.S. Pat. No. 2,209,123 to Koelbel discloses purification of coal tar oils to remove undesirable asphalt, resin and pitch by treatment with a mixture of paraffin hydrocarbon and a dilute acid such as 20% sulfuric acid. Also, U.S. Pat. No. 3,085,061 to Metrailer, discloses a shale oil refining process using anhydrous hydrogen chloride to treat the oil and return a sludge stream to a coker or reactor. However, these processes recycle to the reactor the heavy bottoms material containing inorganic components.

SUMMARY OF THE INVENTION

The present invention provides a process for catalytic hydroconversion of petroleum feedstocks containing preasphaltenes in which acid is added to a heavy hydrocarbon liquid fraction usually boiling above about 950° F. to precipitate the preasphaltenes with an inorganic acid, such as hydrochloric acid. The acid precipitation step is used to precipitate and decompose preasphaltenes and to coprecipitate solids. Because preasphaltenes contained in the heavy liquid fraction are salts of nitrogen bases and phenolic acids, adding inorganic acids such as hydrochloric and other similar acids have the effect of dissociating these salts and precipitating mineral acid salts of the nitrogen bases. The supernatant overflow material is recycled to the catalytic reaction zone for further hydroconversion, while the precipitated material is withdrawn for further processing such as coking to increase the yield of hydrocarbon products.

Such an acid precipitation step has several beneficial effects, in that it decomposes the preasphaltene molecules and liberates the acid component, which is useful as a product or feedstock. Also, it precipitates the nitrogen base compounds preferentially. These materials are particularly injurious as fuels or feedstocks due to their tendency to form $NO_x$ and to poison catalysts. Nitrogen is a particularly difficult element to remove by hydrogenation. The precipitating nitrogenous material will coprecipitate solid materials, resulting in a clean overflow stream having low viscosity and providing a means for removing solid organic and inorganic debris from the system with minimum loss of useful product.

The precipitated high nitrogen, high sulfur material can be further processed in a variety of ways, such as coking to recover light product fractions, combustion with stack gas scrubbing or incineration.

Although this invention is preferably used for processing petroleum feedstocks containing preasphaltenes, it is also useful for the hydroconversion processing of other hydrocarbon liquids containing preasphaltenes which can be precipitated by an inorganic acid, such as bitumen recovered from tar sands and coal-derived liquids having low ash solids.

DESCRIPTION OF DRAWING

The drawing is a schematic flowsheet illustrating a process for the catalytic hydroconversion of petroleum feedstocks containing preasphaltenes according to the present invention.

DESCRIPTION OF PREFERRED EMBODIMENT

As illustrated in the drawing, a petroleum feedstock containing at least about two weight percent preasphaltenes and at least about 10 ppm total metals is provided at 10, is pressurized by pump 12, heated at 14, and introduced into catalytic hydrogenation reactor 20. Recycle medium-purity hydrogen at 15 is also heated and added to the reactor, along with high purity make-up hydrogen at 15*a*.

Operating conditions in reactor 20 are usually maintained within the ranges of 700°-900° F. temperature and 1000-5000 psig partial pressure of hydrogen. The reactor 20 is preferably an upflow ebullated catalyst bed type, as the recycle preasphaltene material can be processed more effectively therein without causing plugging difficulties as might occur for fixed bed type reactors. Fresh particulate catalyst in microsphere form may be added with the feed 10, or larger extrudate type catalyst added directly into the reactor at 18, and used catalyst can be withdrawn periodically as needed at 19 so as to maintain the catalyst activity in the reactor at a desired level. The reactor liquid is recycled through downcomer conduit 23 and pump 24 to maintain the desired ebullation of the catalyst bed, as generally taught by U.S. Pat. No. 3,412,010 the description of which is incorporated herein by reference to the extent needed.

Reactor effluent material is removed as stream 25 and passed to hot phase separator 26, where it is separated into gaseous and liquid fractions. The resulting gaseous fraction is removed overhead at 27, cooled at 29, and passed to a second phase separation step at 30. The hydrogen-rich overhead gas 31 is purified in hydrogen purification system 32, so as to provide the medium purity hydrogen recycle stream 15. The resulting separator bottoms light hydrocarbon liquid stream 34 is pressure-reduced at 35 and passed to fractionation step 36 for separation into various liquid product streams as explained below.

Returning now to hot-phase separation step 26, separator liquid stream 28 containing preasphaltenes is also pressure-reduced and passed to a fractionation step 36. Herein the two liquid feedstreams 28 and 34 are fractionated so as to usually produce for example a gas stream 37, a light ends stream withdrawn at 39, a naphtha fractions at 39, a distillate or diesel fuel fraction at 40, and a remaining heavy liquid fraction withdrawn at 41. The heavy liquid stream 41 is passed to vacuum distillation step at 42, from which overhead light liquid stream 43 is withdrawn. Vacuum bottoms stream 44, usually boiling above 950° F. and preferably above 975° F., is passed to precipitation step 46, where the liquid is mixed with an acid stream 47. A substantial portion of the preasphaltene fraction in liquid stream 44 is precipitated in settler 46 and removed at 49. Overhead stream 48 containing reduced concentration of preasphaltenes is recycled to reactor 20 for further reaction. Most of the preasphaltene material is withdrawn as stream 49 for further processing as desired.

The operating conditions necessary for causing the precipitation at 46 of asphaltenes contained in vacuum bottoms fraction stream 44 requires that the temperature of the precipitation 46 be about 300°-500° F. The amount of acid needed to cause such precipitation of preasphaltenes will vary with the preasphaltene content of the feed. The amount of acid 47 added to heavy oil feed at 44 should usually be within the range of 3-10 W % acid based on preasphaltenes in the heavy liquid stream, with the higher ratios of acid required for the precipitation of increased percentages of preasphaltenes.

The acid that is added with the feed may be a Bronstead acid such as hydrochloric (HCl), sulfuric ($H_2SO_4$) or phosphoric ($H_3PO_4$), or a Lewis acid such as boron trifluoride ($BF_3$) ferric chloride ($FeCl_3$) or aluminum chloride ($AlCl_3$).

The pressure level in the precipitation step 46 should be at least equal to the system vapor pressure, and will usually be within the range of 200-600 psig. The precipitation step temperature should be sufficient to maintain fluidity in the system, and will generally be in the range of 300°-500° F. Heavy bottoms stream 49 can be passed to coker 50, from which additional distillate product material is recovered at 51. Coke product is removed at 52.

As an alternative embodiment of this invention, fine particulate size catalyst may be utilized in the reactor, i.e., catalyst having average particle size smaller than about 0.016 inch diameter. When using such fine catalyst, a portion of the fine catalyst is usually carried overhead from the reactor 20 along with the effluent liquid stream 25. It is a feature of this invention that such fine catalyst carried out of the reactor in stream 25 is substantially removed from liquid stream 44 at precipitation step 46, along with the precipitation preasphaltene material at 48, resulting from the addition of an acid from stream 47. If desired, spent catalyst can be withdrawn from the reactor at connection 19 and replaced with fresh catalyst at connection 18 as necessary to maintain the desired level of catalytic activity in reactor 20.

Although this invention has been described in terms of the accompanying diagram and preferred embodiments, it will be appreciated by those skilled in the art that various modifications and adaptions of the basic process are possible within the spirit and scope of the invention, which is defined by the following claims.

I claim:

1. A process for hydroconversion of heavy hydrocarbon feedstocks containing preasphaltenes to produce lower-boiling hydrocarbon liquid products, comprising:

(a) introducing the feedstock with hydrogen into a catalytic reaction zone at reaction conditions within the ranges of 700°-900° F. temperature, and 1000-5000 psig hydrogen partial pressure for providing hydroconversion reactions therein;

(b) withdrawing reacted hydrocarbon liquid effluent material containing preasphaltenes and passing the material to phase separation and distillations steps to provide light product fractions and a bottoms fraction material stream normally boiling above about 950° F. and containing preasphaltenes;

(c) adding acid to said bottoms fraction material in a precipitation step to cause precipitation of the preasphaltene material;

(d) withdrawing an overhead liquid stream from said precipitation step and recycling the stream to the reaction zone for further hydroconversion therein;

(e) withdrawing a bottoms liquid fraction containing precipitated asphaltenes from the precipitation step for further processing to recover additional hydrocarbon liquid products; and (f) withdrawing from the distillation step the hydrocarbon liquid products.

2. The process of claim 1, wherein the feedstock contains at least about 2 weight percent preasphaltenes, and the acid added is hydrochloric acid.

3. The process of claim 2, wherein the amount of acid added to the feed to the precipitation step is between about 3 and 10 W % of the preasphaltenes in the heavy bottoms fraction feed streams to the precipitation step.

4. The process of claim 2, wherein the precipitation step temperature is 300°-500° F.

5. The process of claim 2, wherein the acid precipitation step pressure is between 200 and 600 psig.

6. The process according to claim 1, wherein the acid added to said bottoms fraction material is $H_2SO_4$, $H_3PO_4$, HCl, $FeCl_3$, $AlCl_3$ or $BF_3$.

7. The process of claim 1, wherein the precipitated bottoms material from the acid precipitation step is coked to recover additional light liquid product fractions.

8. A process for hydroconversion of heavy hydrocarbon feedstocks containing preasphaltenes to produce lower-boiling hydrocarbon liquid products, comprising:

(a) introducing the feedstock containing at least about 2 W % asphaltenes with hydrogen into a catalytic reaction zone at reaction conditions within the ranges of 700°-900° F. temperature and 1000-5000 psig hydrogen partial pressure for hydroconversion reactions therein;

(b) withdrawing reacted hydrocarbon liquid effluent material containing asphaltenes and passing the material to phase separation and distillation steps, to provide light product fractions and a bottoms fraction stream normally boiling above about 950° F. and containing asphaltenes;

(c) adding hydrochloric acid to said bottoms fraction in a precipitation step at 300°-500° F. temperature and 200-600 psig pressure to cause precipitation of the asphaltenes materials;

(d) withdrawing an overhead liquid stream from said precipitation step and recycling the stream to the reaction zone for further hydroconversion therein;

(e) withdrawing a bottoms liquid fraction containing precipitated asphaltenes from the precipitation step for further processing to recover additional hydrocarbon liquid products;

(f) withdrawing from the distillation step the hydrocarbon liquid products.

9. A process for hydroconversion of heavy hydrocarbon feedstocks containing preasphaltenes to produce lower-boiling hydrocarbon liquid products, comprising:

(a) introducing the feedstock containing at least about 2 W % asphaltenes with hydrogen into a catalytic reaction zone at reaction conditions within the ranges of 700°-900° F. temperature and 1000-5000 psig hydrogen partial pressure for hydroconversion reactions therein;

(b) withdrawing reacted hydrocarbon liquid effluent material containing asphaltenes and passing the material to phase separation and distillation steps, to provide light product fractions and a bottoms fraction stream normally boiling above about 950° F. and containing asphaltenes;

(c) adding hydrochloric acid to said bottoms fraction in a precipitation step in an amount of between about 3 and 10 W % of the preasphaltenes in said bottoms fraction and at 300°-500° F. temperature and 200-600 psig pressure to cause precipitation of the asphaltenes material;

(d) withdrawing an overhead liquid stream from said precipitation step and recycling the stream to the reaction zone for further hydroconversion therein;

(e) withdrawing a bottoms liquid fraction containing precipitated asphaltenes from the precipitation step and coking said precipitated bottoms liquid fraction to recover additional light liquid hydrocarbon products, for further processing; and (f) withdrawing from the distillation step the hydrocarbon liquid products.

* * * * *